US006225875B1

(12) United States Patent
Kich

(10) Patent No.: US 6,225,875 B1
(45) Date of Patent: May 1, 2001

(54) DUAL SIDEWALL COUPLED ORTHOMODE TRANSDUCER HAVING SEPTUM OFFSET FROM THE TRANSDUCER AXIS

(75) Inventor: Rolf Kich, Redondo Beach, CA (US)

(73) Assignee: Hughes Electronics Corporation, El Segundo, CA (US)

( * ) Notice: Subject to any disclaimer, the term of this patent is extended or adjusted under 35 U.S.C. 154(b) by 0 days.

(21) Appl. No.: 09/167,052

(22) Filed: Oct. 6, 1998

(51) Int. Cl.[7] ..... H01P 1/161
(52) U.S. Cl. ..... 333/125; 333/137; 333/21 A
(58) Field of Search ..... 333/125, 126, 333/135, 137, 21 A

(56) References Cited

U.S. PATENT DOCUMENTS 3,201,717 8/1965 Grosbois et al. .
3,668,567 6/1972 Rosen ..... 333/21 A

FOREIGN PATENT DOCUMENTS

114155 * 9/1979 (JP) ..... 333/137
4304 * 1/1985 (JP) ..... 333/135
158201 * 7/1986 (JP) ..... 333/137
89401 * 3/1990 (JP) ..... 333/135
4373201 * 12/1992 (JP) ..... 333/21 A

OTHER PUBLICATIONS

European Search Report in Application No. EP 99 11 9563 dated Jan. 10, 2000.

* cited by examiner

*Primary Examiner*—Benny Lee
(74) *Attorney, Agent, or Firm*—T. Gudmestad

(57) ABSTRACT

A waveguide for guiding an arbitrarily polarized electrical field includes an elongated housing having a sidewall and a pair of feed ports located on the housing sidewall. One of the feed ports guides the horizontal component of the electrical field, while the other feed port guides the vertical component of the electrical field. A pair of planar septums are disposed within the housing and intersect along a line parallel to the axis of the housing.

22 Claims, 2 Drawing Sheets

DUAL SIDEWALL COUPLED ORTHOMODE TRANSDUCER HAVING SEPTUM OFFSET FROM THE TRANSDUCER AXIS

The present invention relates generally to waveguides for guiding electrical fields. More specifically, the present invention relates to an orthomode transducer waveguide having dual sidewall feed ports.

BACKGROUND OF THE INVENTION

Waveguides are used to guide electrical fields. An orthomode transducer (OMT) is a type of waveguide which is designed to decompose an arbitrarily polaried electrical field into its various components. Prior art OMT's are typically of tubular construction, with one of the feed ports located on the cylindrical sidewall and the other feed port located on the circular endwall. Alternatively, the OMT may have a square or rectangular cross section with a corresponding square or rectangular endwall.

On prior art OMT's, the signal used to feed the endwall port must pass over the septum used to feed the sidewall port, thus causing interference. The length of the septum is resonant at some frequency, which decreases the usable band width of the endwall feed port. Moreover, the endwall port increases the overall length of the OMT, and thus coupling two OMT's together is made more difficult, as side mounted phase shifters must be employed.

SUMMARY OF THE INVENTION

According to one aspect of the present invention, a waveguide or OMT includes a tubular housing having a pair of feed ports, both of which are mounted on the housing sidewall. One of the ports guides the horizontal component of an arbitrarily polarized electrical field, while the other port guides the vertical component of the electrical field. Preferably, the ports are oppositely disposed from each and are generally located at the same position along the axis of the housing. One port is oriented longitudinally and forms an H plane bend into the tubular waveguide. The second port is oriented transversely and forms an E plane bend into the tubular waveguide. A pair of planar septums are disposed within the housing, and intersect each other along a line parallel to the axis of the housing. Preferably, the line of intersection is spaced a fixed distance away from the centerline of the housing, with optimum results being obtained when the fixed distance is equal to approximately 48% of the housing radius measured from the housing centerline. Finally, each of the septums preferably includes a shaped or contoured leading edge. For example, the leading edge of the H plane bend septum preferably includes a pair of parabolic indentations spaced symmetrically about the housing centerline, while the E plane bend septum preferably includes a protrusion having an apex spaced from the housing centerline a distance equal to approximately 39% of the housing radius measured from the housing centerline. Horizontal and vertical tuning stubs are also provided along the housing sidewall.

According to another aspect of the invention, a waveguide includes a cylindrical housing having a sidewall and a pair of feed ports located on the sidewall, with each sidewall having a central axis extending away from the housing. Each of the ports is configured to guide one component of a polarized electrical field, and a pair of intersecting planes are disposed within the housing, each plane being generally perpendicular to the axis of its associated feed port. The planes intersect along a line generally parallel to the axis of the cylindrical housing.

According to yet another aspect of the present invention, a waveguide includes an elongated cylindrical housing that defines a central axis. A first feed port and a second feed port are disposed about the sidewall opposite from each other, and each of the ports are spaced at a common point along the central axis of the housing. Each of the ports includes a longitudinal axis that extends perpendicular from the central axis of the housing. A septum having a pair of intersecting planes is disposed within the housing. One of the planes is located perpendicular to the axis of the first feed port, while the second plane is located perpendicular to the axis of the second feed port.

A dual sidewall feed OMT according to the present invention will be shorter and more compact than a prior art OMT. The length of a variable power divider (VPD) constructed using the present OMT will be shorter by at least 12% than that obtainable using conventional OMT's. Performance is improved and usable bandwidth is increased because neither signal must pass through the septum used to feed the orthogonal mode. When used on VPD's, the shortened overall construction with an uninterrupted endwall allows the use of a simple motor and shaft mechanism rather than the more complicated sidewall motors for the phase shifters as is required by prior art OMT's.

DETAILED DESCRIPTION OF THE PREFERRED EMBODIMENT

Figure 1:
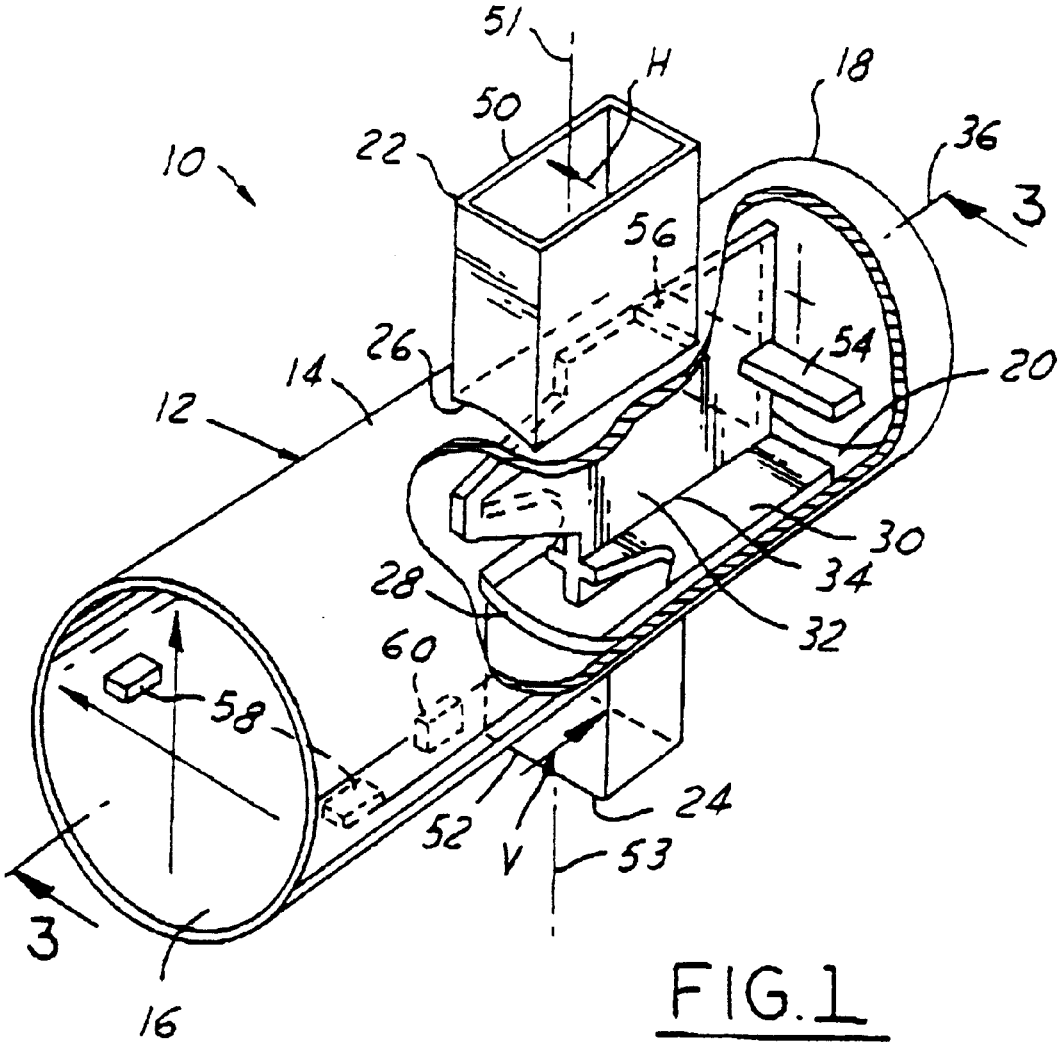
FIG. 1 is a perspective view of a dual sidewall feed orthomode transducer according to the present invention.
Figure 3:
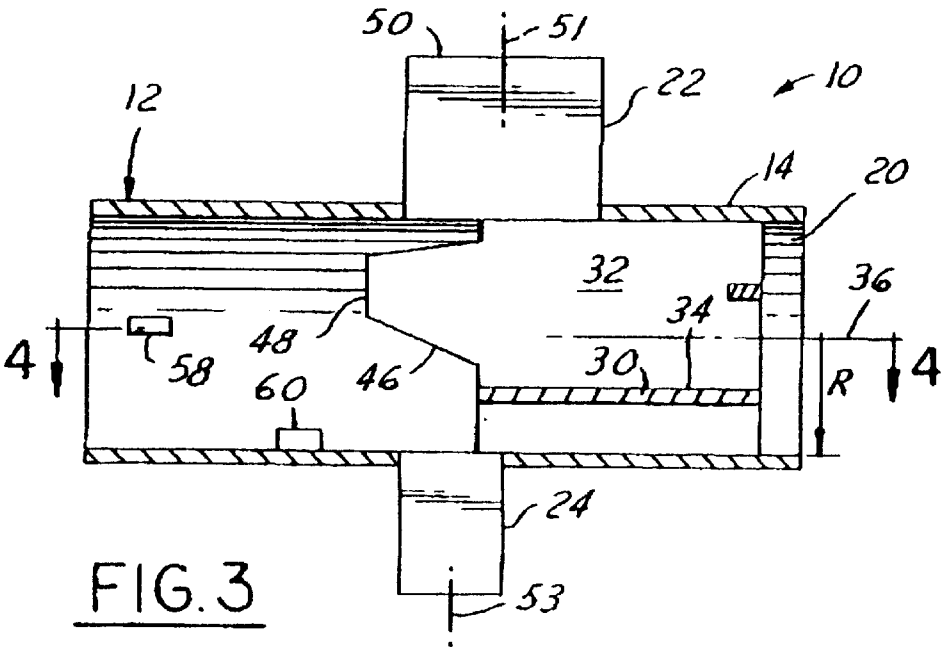
FIG. 3 is a cross-sectional view taken along line 3—3 of FIG. 1.
Figure 4:
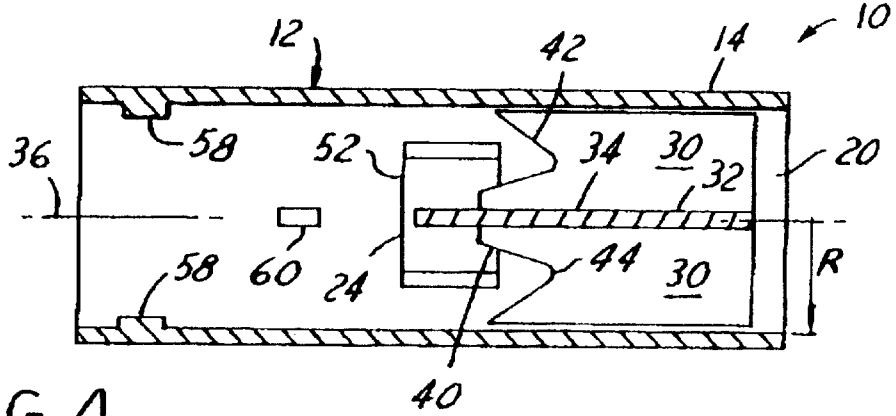
FIG. 4 is a cross-sectional view taken along lines 4—4 of FIG. 3.

Referring now to the drawings where like reference numerals indicate like elements, a waveguide incorporating the features of the present invention is generally referred to by the reference numeral 10, and is typically used to decompose an arbitrarily polarized electrical field into its horizontal component, generally indicated by the reference arrow "H", (FIG. 1) and its vertical component, generally indicated by the reference arrow "V". (FIG. 1) Waveguide 10 includes a housing 12 having a side wall 14. Housing 12, which is preferably generally cylindrical in shape, includes an input end 16 and an output end 18 having an end wall 20 as indicated in FIGS. 1, 3 and 4. A pair of feed ports 22, 24 are oppositely disposed about sidewall 14. The feed port 22 is viewable only in FIGS. 1–3. The feed ports 22, 24 each include an inductive iris window 26, 28, respectively as shown in FIG. 1 only. A pair of planar septums 30, 32 are disposed within housing 12, and septums 30 and 32 intersect along a line of intersection 34 shown in FIG. 1 which is generally parallel to a longitudinal axis 36 (FIGS. 1, 3 and 4) of housing 12. Preferably, septums 30, 32 are generally perpendicular to each other. As shown in FIG. 3, it can be seen that the housing 12 has a radius indicated by the reference arrow "R". Preferably, the line of intersection 34 is spaced away from the longitudinal axis 36 of housing 12 a distance equal to about 48% of the radius R.

Septum 30 includes a leading edge 40 (FIG. 4) having a pair of depressions or indentations 42, 44 (FIG. 4) which are spaced symmetrically relative to the line of intersection 34 and which are generally parabolic in shape. Alternatively, other generally rounded or scalloped shaped indentations may produce favorable results as well. As shown in FIG. 3, septum 32 includes a leading edge 46 having an apex 48. The center of apex 48 is spaced away from the axis 36 of housing 12 a distance equal to about 39% of the radius R. Apex 48 is shown as being linear, although other shapes may provide advantageous results as well.

Figure 2:
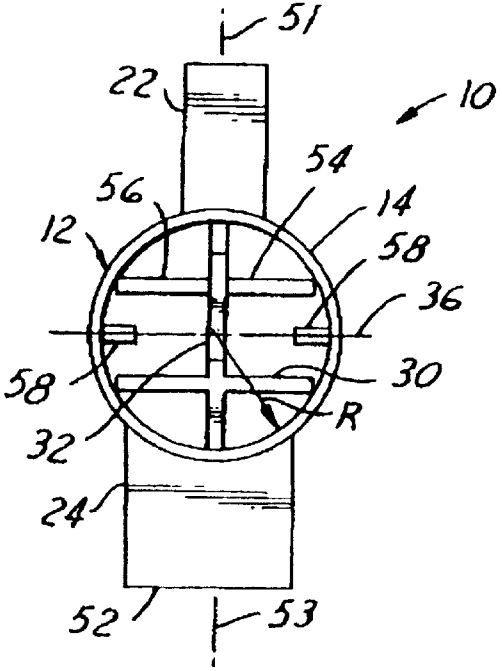
FIG. 2 is a front elevational view of the device shown in FIG. 1.

Referring now to FIGS. 1 through 3, feed port 22 has a rectangular cross-section having a longitudinal dimension 50 (FIGS. 1, 2 and 3) and defines a central axis 51 (FIGS. 1, 2 and 3). Referring again to FIGS. 1 and 3, longitudinal dimension 50 is oriented generally parallel to the axis 36 of housing 12 while central axis 51 is oriented generally perpendicular to and extending away from axis 36 of housing 12. Similarly, feed port 24, best shown in FIG. 2, has a rectangular cross-section having a longitudinal dimension 52 and defines a central axis 53. Longitudinal dimension 52 is oriented transversely relative to axis 36 as shown in FIG. 4, while axis 53 extends generally perpendicular to and away from axis 36 of housing 12 as shown in FIG. 2. Also as shown in FIGS. 1 and 2, a pair of secondary horizontal septums 54, 56 extend from either side of septum 32, in order to minimize leakage through end wall 20. Horizontal and vertical tuning stubs 58, 60 are provided for tuning the H and V components, respectively, of the electrical field.

In operation, an arbitrarily polarized electrical field is routed to the waveguide 10 via the input end 16 as shown in FIG. 1. The response characteristics of the horizontal H and vertical V components of the electrical field can be altered using the tuning stubs 58, 60, respectively. The septums 30, 32, with the assistance of their associated inductive iris windows 26, 28, feed the H and V components of the electrical field through their respective ports 20, 22.

Those skilled in the art will further appreciate that, although the invention has been described in connection with certain embodiments, there is no intent to limit the invention thereto. On the contrary, the invention of this application is to cover all modifications and embodiments fairly falling within the scope of the appended claims either literally or under the doctrine of equivalence.

What is claimed:

1. A waveguide, comprising:

a cylindrical housing defining a central axis;

first and second feed ports disposed diametrically opposite each other about the sidewall of the cylindrical housing, the ports being disposed at a common point along the central axis, each of the ports having a respective longitudinal axis extending perpendicular from the central axis; and a septum disposed in the housing and having first and second intersecting planes, the first plane being perpendicular to the axis of the first feed port and the second plane being parallel to the axis of the second feed port.

2. The waveguide of claim 1, wherein said housing includes an input end and said septum includes a respective leading edge facing toward said input end, and wherein said first and second planes intersect along a line of intersection, said septum including a pair of indentations on said respective leading edge thereof spaced symmetrically about said line of intersection.

3. The waveguide of claim 1, wherein said housing includes an input end and said septum includes a repective leading edge facing toward said input end, said septum including a protrusion extending away from said respective leading edge thereof, said protrusion having an apex spaced away from the axis of said housing a distance of about 39% of the radius of said housing.

4. A waveguide for guiding an electrical field having a horizontal component and a vertical component, the waveguide comprising:

a housing having a sidewall and defining a longitudinal axis;

first and second feed ports located on said sidewall and being disposed substantially diametrically opposite each other, said first feed port for guiding the horizontal component of the electrical field, said second feed port for guiding the vertical component of the electrical field; and first and second planar septums disposed within said housing, said septums intersecting along a line of intersection parallel to the longitudinal axis of said housing.

5. The waveguide of claim 4, therein said housing is cylindrical.

6. The waveguide of claim 4, wherein said first and second planar septums are substantially perpendicular to each other.

7. The waveguide of claim 6, wherein said housing is cylindrical and further wherein said first and second septums intersect each other along said line of intersection spaced away from the longitudinal axis of said housing.

8. The waveguide of claim 7, wherein said line of intersection is spaced away from the longitudinal axis of said housing a distance equal to about 48% of the radius of said housing.

9. The waveguide of claim 4, wherein said housing is cylindrical, each of said first and second feed ports defining a respective axis extending radially outward from said housing, said first feed port axis extending generally perpendicular to the plane of said first planar septum, said second feed port axis extending generally parallel to the plane of said second planar septum.

10. The waveguide of claim 9, wherein said housing is cylindrical and said first and second septums intersect along said line of intersection spaced away from the longitudinal axis of said housing.

11. The waveguide of claim 10, wherein said first septum is spaced away from the longitudinal axis of said housing a distance equal to about 48% of the radius of said housing.

12. The waveguide of claim 4, wherein said housing is cylindrical and includes an input end and each of said first and second septums includes a respective leading edge disposed toward said input end, said second septum including a protrusion extending from said leading edge thereof, said protrusion having an apex spaced away from the longitudinal axis of said cylindrical housing a distance of about 39% of the radius of said housing.

13. The waveguide of claim 4, wherein said housing includes an input end and each of said first and second septums includes a respective leading edge facing toward said input end, said first septum including a pair of indentations on said leading edge thereof spaced symmetrically about said line of intersection.

14. A waveguide for guiding an electrical field, comprising:

a cylindrical housing having a first end, a second end, a sidewall extending between the first and second ends, and defining an axis extending between the first and second ends;

a first feed port located on said sidewall and having a central axis thereof extending away from said housing, said first feed port for guiding a first component of the electrical field;

a second feed port located on said sidewall diametrically opposite to said first feed port and having a central axis thereof extending away from said housing, said second feed port for guiding a second component of the electrical field;

a first planar septum mounted within said housing, said first planar septum being disposed substantially perpendicular to the axis of said first feed port; and a second planar septum mounted within said housing, said second planar septum being disposed substantially parallel to the axis of said second feed port, said first planar septum meeting said second planar septum along a line of intersection, said line of intersection lying generally parallel to the axis of said housing.

15. The waveguide of claim 14, wherein said first septum includes leading edge having a pair of parabolically-shaped indentations.

16. The waveguide of claim 14, wherein said first and second planar septums are substantially perpendicular to each other.

17. The waveguide of claim 16, wherein said housing is cylindrical and further wherein said first and second septums intersect each other along said line of intersection spaced away from the centerline of said housing.

18. The waveguide of claim 17, wherein said line of intersection is spaced away from the axis of said housing a distance equal to 48% of the radius of said housing.

19. The waveguide of claim 14, wherein said second septum includes a leading edge having a scalloped protrusion.

20. The waveguide of claim 14, wherein said housing includes an input end and each of said first and second septums includes a respective leading edge facing toward said input end, said second septum including a protrusion extending from said leading edge thereof, said protrusion having an apex spaced away from the longitudinal axis of said housing a distance of about 39% of the radius of said housing.

21. The waveguide of claim 14, wherein said housing includes an input end and each of said first and second septums includes a respective leading edge facing toward said input end, said first septum including a pair of indentations on said leading edge thereof spaced symmetrically about said line of intersection.

22. The waveguide of claim 14, wherein said respective central axis of said first feed port extending substantially perpendicular relative to said first planar septum, said respective central axis of said second feed port extending substantially parallel relative to said second planar septum.

* * * * *